US007954410B2

(12) United States Patent
Prescott et al.

(10) Patent No.: US 7,954,410 B2
(45) Date of Patent: Jun. 7, 2011

(54) FAST ROPE

(75) Inventors: Amos Neal Prescott, Yarmouth, ME (US); Todd Anderson, California, MD (US); Douglas Mousseau, Leonardtown, MD (US); Stan Zanis, Manchester, NH (US)

(73) Assignee: The United States of America represented by the Secretary of the Navy, Washington, DC (US)

( * ) Notice: Subject to any disclaimer, the term of this patent is extended or adjusted under 35 U.S.C. 154(b) by 90 days.

(21) Appl. No.: 12/469,197

(22) Filed: May 20, 2009

(65) Prior Publication Data

US 2010/0294114 A1 Nov. 25, 2010

(51) Int. Cl.
*D04C 1/12* (2006.01)

(52) U.S. Cl. ..... 87/6; 87/8; 87/13

(58) Field of Classification Search ..... 87/6, 8, 87/13

See application file for complete search history.

(56) References Cited

U.S. PATENT DOCUMENTS

| | | | | |
|---|---|---|---|---|
| 4,058,049 | A * | 11/1977 | Bech | 87/8 |
| 7,244,155 | B1 * | 7/2007 | Nye et al. | 441/23 |
| 2007/0079695 | A1 * | 4/2007 | Bucher et al. | 87/8 |
| 2007/0169457 | A1 * | 7/2007 | Kijesky | 57/210 |

* cited by examiner

*Primary Examiner* — Shaun R Hurley
(74) *Attorney, Agent, or Firm* — Mark O. Glut

(57) ABSTRACT

A fast rope, which includes a weighted core, a first braid surrounding the core, a second braid surrounding the first braid, and a third braid surrounding the second braid. The core is constructed from lead wires extruded over a polyester yarn, the first braid is strands of polypropylene, the second braid is strands of composite press material, and the third braid is strands of spun polyester.

7 Claims, 2 Drawing Sheets

FAST ROPE

STATEMENT OF GOVERNMENT INTEREST

The invention described herein may be manufactured and used by or for the Government of the United States of America for governmental purposes without payment of any royalties thereon or therefor. The technology described herein was a subject invention under contract number W91CRB-07-0083 with the United States Navy.

BACKGROUND

The present invention relates to a rope. More specifically, but without limitation, the present invention relates to a ballast braid fast rope.

Currently, the United States Navy utilizes an eight (8) plait rope construction with no core when personnel rapidly descent from aircraft. Extreme downwash (downwash may be defined, but without limitation, as downward air turbulence caused by the motion or action of a propeller or jet) or other turbulent conditions make this rope unusable.

Other types of ropes are also uncontrollable in high downwash and low altitude conditions. Uncontrollable ropes may interfere with rotor or propeller blades (potentially causing a crash) or strike personnel on the ground. Additionally, uncontrolled ropes also may make it difficult for users to grasp the rope or safely control a fast rope descent.

For the foregoing reasons, there is a need for a fast rope that allows personnel to rapidly descend from aircraft in extreme downwash or turbulent conditions.

SUMMARY

The present invention is directed to a fast rope that meets the needs enumerated above and below.

The present invention is directed to a fast rope, which includes a weighted core, a first braid surrounding the core, a second braid surrounding the first braid, and a third braid surrounding the second braid. The core is constructed from lead wires extruded over a polyester yarn, the first braid is strands of polypropylene, the second braid is strands of composite press material, and the third braid is strands of spun polyester.

It is a feature of the present invention to provide a fast rope that can be deployed more safely than currently used ropes. The present invention hangs vertically below the aircraft with minimal whip or drift.

It is a feature of the present invention to provide a fast rope that performs in high wind or prop wash due to the inclusion of dissimilar density materials in the composite rope structure. These materials effectively resist the harmonic wave action common in a rope with uniform material construction.

It is a feature of the present invention to provide a fast rope that is strong and dampens potential oscillation of a suspended fast rope. The current invention tends to absorb or dampen the wind energy that might otherwise create an increasingly larger wave.

It is a feature of the present invention to provide a fast rope which can be supplied with total weight being equal in a range of lengths by adjusting the amount of lead ballast per foot of rope without materially changing any other performance characteristic. For example, a 60 foot Ballast braid fast rope can be constructed with the same total weight as a 90 foot version.

DRAWINGS

These and other features, aspects and advantages of the present invention will become better understood with reference to the following description and appended claims, and accompanying drawings wherein:

DESCRIPTION

Figure 1:
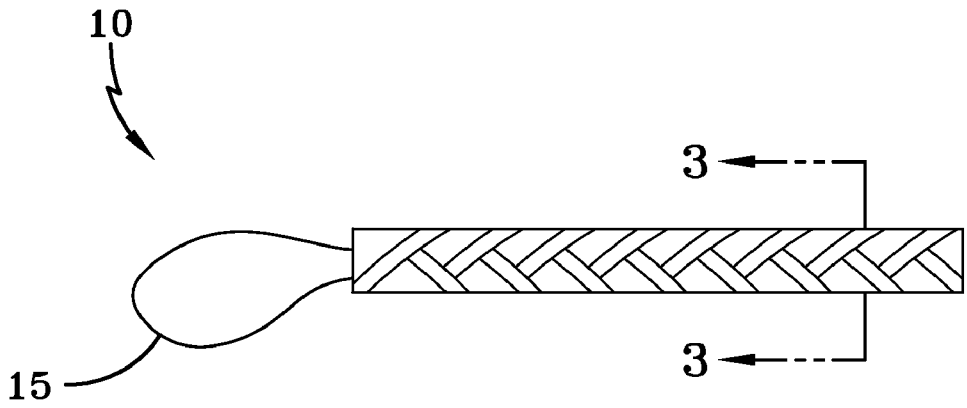
FIG. 1 is a side view of the fast rope.
Figure 2:
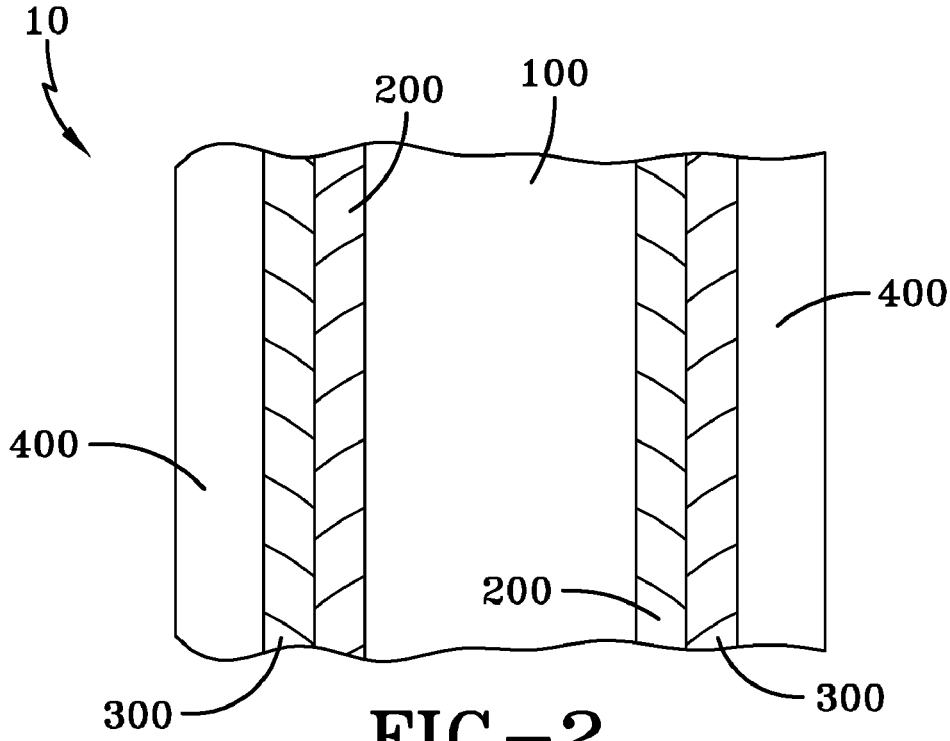
FIG. 2 is an internal side view of the fast rope.
Figure 3:
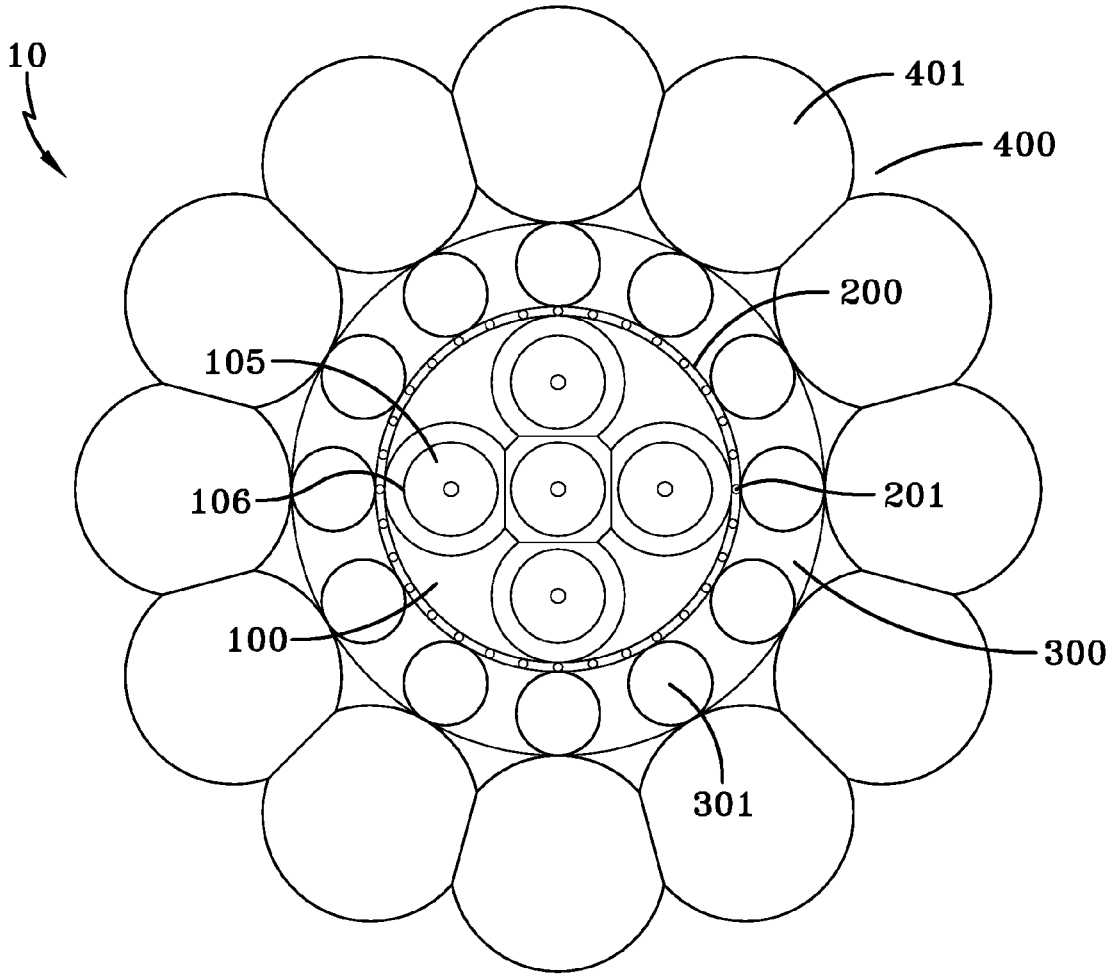
FIG. 3 is a cross sectional view of the fast rope cut along section 3-3 of FIG. 1.

The preferred embodiments of the present invention are illustrated by way of example below and in FIGS. 1-3. As shown in FIGS. 1-3, the fast rope 10 includes a weighted core 100, a first braid 200 surrounding the core 100, a second braid 300 surrounding the first braid 200, and a third braid 400 surrounding the second braid 300. The core 100 is constructed from lead wires extruded over a polyester yarn, the first braid 200 is strands of polypropylene, the second braid 300 is strands of composite press material, and the third braid 400 is strands of spun polyester.

In the description of the present invention, the invention will be discussed in a military environment; however, this invention can be utilized for any type of application that requires use of a weighted rope.

In the preferred embodiment of the invention, the core 100 is center weighted and constructed from lead wires crimped to form flexible strands 105 of ballast weights. The group of flexible strands 105 are overbraided with strands 106 of polypropylene. Overbraided may be defined, but without limitation, as the application of braided strands over a core or mandrel or other object where that completed structure is reintroduced or fed through a braiding operation for the building up of concentric layers. The strands may then be overbraided in parallel with polypropylene or overbraided with twisted strands of black propropylene. In the preferred embodiment of the invention there are five (5) strands 105 of ballast weights.

The core may be a center ballast core that is constructed from lead wires extruded over a polyester yarn. The lead wires are crimped to form flexible strands 105 of ballast weights and each of these strands may be covered with braided strands of black filament polypropylene and white polyester.

The first braid 200 may be polypropylene. In the preferred embodiment, there are about thirty-two (32) strands 201 of polypropylene in the first braid 200.

The second braid 300 is composite press material. The preferred composite press material is high density polyethylene fiber material or Spectra® (generic term—high molecular polyethylene fiber). In the preferred embodiment there are twelve (12) twisted stands 301 of high density polyethylene fiber material or high molecular polyethylene fiber material.

The third braid 400 or cover braid may be spun polyester. In the preferred embodiment there are twelve (12) strands 401 of spun polyester, and can be camouflage green and/or black color. The third braid 400 is not critical to tensile strength performance of the rope. Broken strands 401 or fibers of the third braid 400 will not materially degrade overall strength of the fast rope 10.

The fast rope 10 can be manufactured in standard lengths and can be supplied with spliced terminations to adapt to specific uses such as, but without limitation, specific aircraft attachment requirements. The fast rope 10 may also be spliced in a tight radius to accommodate standard industrial metal or synthetic thimbles 15. This dramatically improves wear resistance of the termination. Current or legacy ropes used by the United States military require a larger loop to create an eye termination. Thimbles cannot be used in the legacy rope, which necessitates a steel loop to rope friction wear point. The fast rope 10 is spliced without materially increasing the diameter of the rope below the eye. This allows a user to grab hold of the fast rope 10 within one foot of the aircraft connection (usually eye level), and the rope has the same diameter across the length of the fast rope 10.

When introducing elements of the present invention or the preferred embodiment(s) thereof, the articles "a," "an," "the," and "said" are intended to mean there are one or more of the elements. The terms "comprising," "including," and "having" are intended to be inclusive and mean that there may be additional elements other than the listed elements.

Although the present invention has been described in considerable detail with reference to certain preferred embodiments thereof, other embodiments are possible. Therefore, the spirit and scope of the appended claims should not be limited to the description of the preferred embodiment(s) contained herein.

What is claimed is:

1. A fast rope, comprising:

a weighted core, the core constructed from lead wires extruded over a polyester yarn, each lead wire is crimped and individually covered with a braid of polyester and polypropylene;

a first braid surrounding the core, the first braid being strands of polypropylene;

a second braid surrounding the first braid, the second braid being strands of high molecular polyethylene fiber material and, a third braid surrounding the second braid, the third braid being strands of spun polyester.

2. The fast rope of claim 1, wherein the lead wires extruded over a polyester yarn form flexible strands of ballast weights.

3. The fast rope of claim 2, wherein the group of strands of ballast weights are overbraided with additional strands of polypropylene.

4. The fast rope of claim 3, wherein there are five (5) flexible strands of ballast weights.

5. The fast rope of claim 4, wherein the first braid has thirty-two (32) strands of polypropylene.

6. The fast rope of claim 5, wherein the second braid has twelve (12) twisted strands of high molecular polyethylene fiber material.

7. The fast rope of claim 6, wherein the third braid has twelve (12) twisted strands of spun polyester.

* * * * *